US007175070B1

(12) United States Patent
Brisport et al.

(10) Patent No.: US 7,175,070 B1
(45) Date of Patent: Feb. 13, 2007

(54) APPARATUS FOR MODIFIED GARBAGE COLLECTOR FOR COMMERCIAL ESTABLISHMENTS

(76) Inventors: Alton J. Brisport, 150 Manchester Rd., Schenectady, NY (US) 12304; Maxine J. Brisport, 150 Manchester Rd., Schenectady, NY (US) 12304

( * ) Notice: Subject to any disclaimer, the term of this patent is extended or adjusted under 35 U.S.C. 154(b) by 0 days.

(21) Appl. No.: 11/356,830

(22) Filed: Feb. 21, 2006

(51) Int. Cl.
*A47G 29/12* (2006.01)

(52) U.S. Cl. ..... 232/43.3; 220/908.3

(58) Field of Classification Search ..... 232/44, 232/43.1–43.3; 220/908, 908.3; 312/211; 209/905; 198/465.1
See application file for complete search history.

(56) References Cited

U.S. PATENT DOCUMENTS 3,675,665 A 7/1972 Sagauth
3,768,493 A 10/1973 Kraeft
4,021,266 A 5/1977 Kitterman
4,609,122 A 9/1986 Ziegenbein
4,740,043 A * 4/1988 Kennamer ..... 312/211
4,878,590 A * 11/1989 Porter ..... 220/890
5,148,975 A 9/1992 Dickerson
5,667,136 A * 9/1997 Chen ..... 232/43.2
D389,630 S 1/1998 Meade, Jr.
5,884,556 A * 3/1999 Klepacki et al. ..... 100/349

* cited by examiner

*Primary Examiner*—William L. Miller

(57) ABSTRACT

The Modified Garbage Collector for Commercial Establishments fulfills the need for an apparatus that can be used to help users collect and dispose garbage in a hygienic way. Once the tray with contents to be disposed is placed inside the Modified Garbage Collector, a series of automated actions help dispose the contents of the tray and store the tray for later use.

1 Claim, 5 Drawing Sheets

APPARATUS FOR MODIFIED GARBAGE COLLECTOR FOR COMMERCIAL ESTABLISHMENTS

1. FIELD

The present disclosure pertains to an apparatus for Modified Garbage Collector for Commercial Establishments, in particular to fulfill the need for an improved garbage collecting mechanism for commercial establishments such as restaurants and fast-food chains.

2. DESCRIPTION OF RELATED ART

The persistent need for a device that allows hygienic collection and disposal of garbage is understood by any person having to collect and dispose garbage. Various methods have been invented in the past to provide modified and hygienic method of collection of garbage.

Some of the prior patents are U.S. Pat. Nos. 5,148,975, 4,609,122, 4,021,266, 3,768,493, 3,675,665.

However, it has been found that the inventions related to prior patents are structurally and functionally different than the present one. For example, some of the prior patents have designs that are bigger and bulkier than the present design. Other prior patents mentioned here have designs have mechanical designs with pulleys and springs. This might lead to mechanical breakdown during constant use.

3. BRIEF DESCRIPTION OF THE FIGURES

The present invention is illustrated by way of an example and is not limited by the figures presented in the following sections:

FIG. 1 illustrates the isometric view of the embodiment, which is the Modified Garbage Collector for Commercial Establishments 101. This figure illustrates parts such as the tray platform opening 102, trash receptacle 103, conveyor belt 104, and door to remove trash 105.

FIG. 2 illustrates the top cross-sectional view of the embodiment shown in FIG. 1. This figure illustrates parts such as the tray 106, lower guide 107, upper guide 109, sensor 108, suction clamp 110, cross members 111, and pivot point 112.

FIG. 3 illustrates the cross-sectional side view of the embodiment shown in FIG. 1 and illustrates the tray 106 with the trash 113 being pushed in 114, conveyer belt 104, and activate suction clamp 110.

Figure 1:
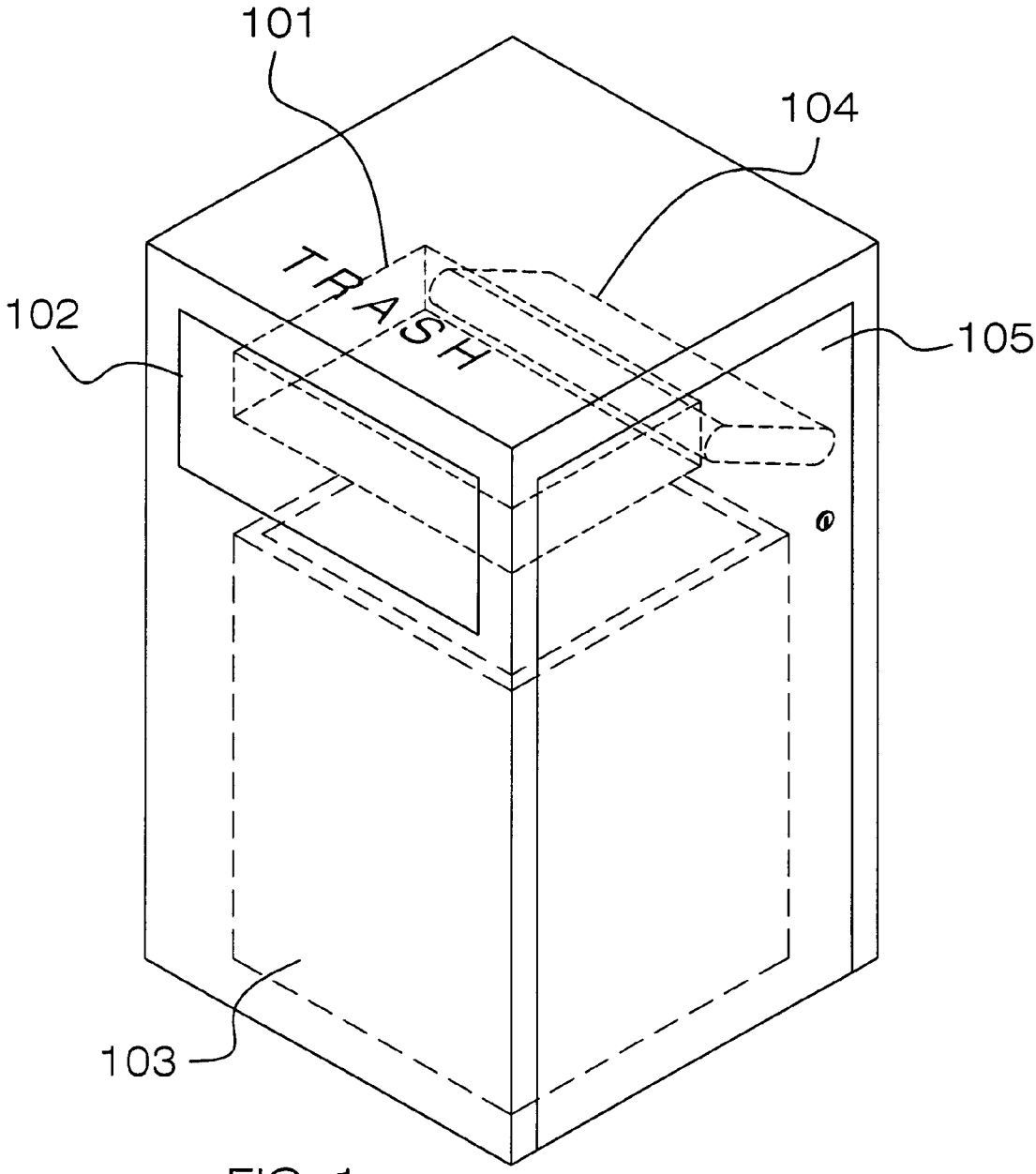
Figure 6:
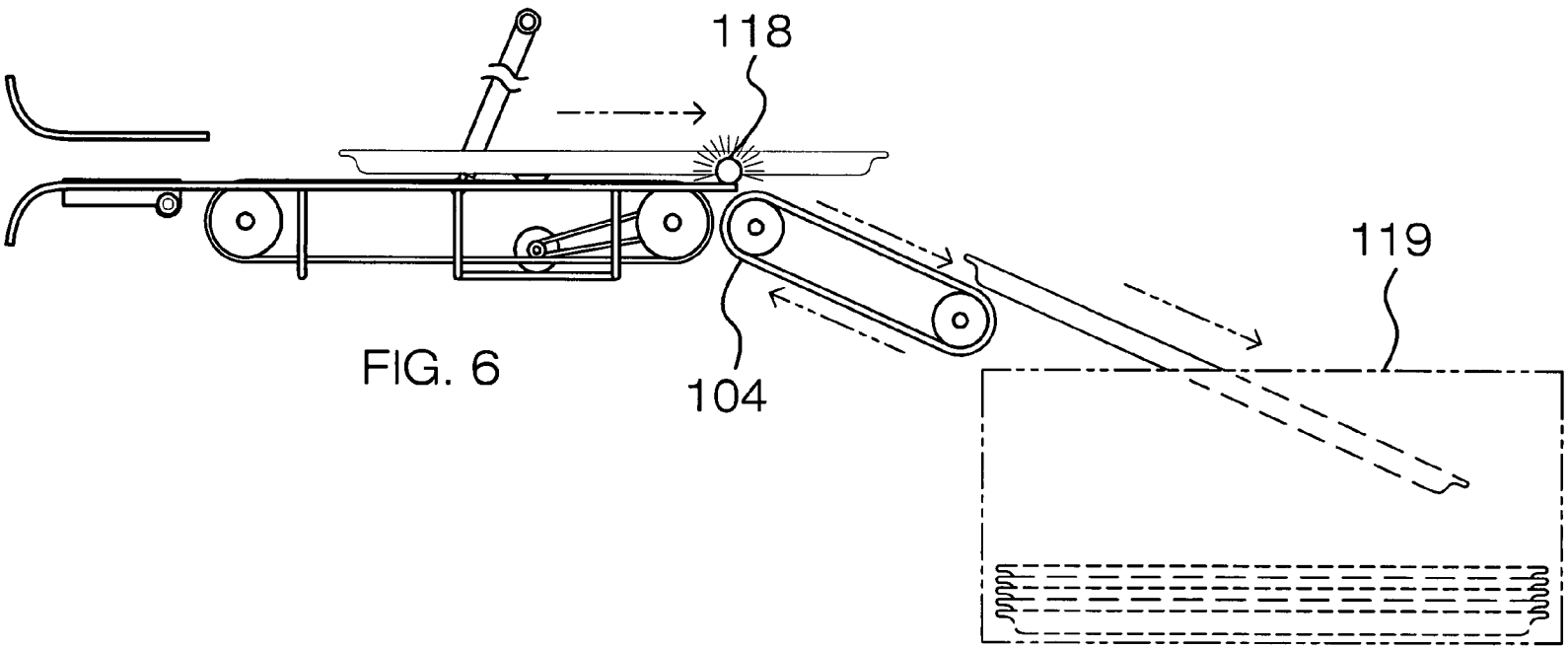

FIG. 6 illustrates the side cross-sectional view of the embodiment shown in FIG. 1 of how the tray 106 moves when the sensor 118 activates the conveyor belt 117 and is stored in the tray dispenser 119 after the garbage has been disposed.

4. DETAILED DESCRIPTION

The following description provides an apparatus for Modified Garbage Collector for Commercial Establishments that fulfills the need for an apparatus that can be used to help users collect and dispose garbage in a hygienic way. The following sections provide a description of the apparatus for Modified Garbage Collector for Commercial Establishments, its specific details, its features and its advantages over the other prior models.

As previously discussed, some of the prior patents have designs that are bigger and bulkier than the present design. Other prior patents mentioned here have designs have mechanical designs with pulleys and springs. This might lead to mechanical breakdown during constant use. In contrast, the apparatus described as an embodiment in FIG. 1 is structurally different from all prior patents and endeavors to overcome the limitations faced by prior patents. It is an object of this invention to ensure good hygienic practices for users disposing trash in commercial establishments such as restaurants, food courts, etc. Another object of this invention is to provide a touch free method of disposing trash and thus reduce or decrease the spread of germs and bacteria from one user or customer to the next. Another object of this invention is to be appealing to users and customers alike because of the unique way of disposing the trash. Another object of this invention is to provide the ability to stack and store the used trays in an organized manner such that they can be easily removed for cleaning. Another object of this invention is to fulfill the need for a clean bacteria and germ free environment and thus help control the amount of people who are affected by surface borne germs and bacteria. In one embodiment, after a meal is finished, the user places the tray on a platform that slightly protrudes from the door or opening of the trash receptacle. An automatic sensor activates a clamp, which firmly holds the tray on the platform. After the clamp is attached, the tray is then transported by way of a gliding track that is built inside the housing of the apparatus. As the platform with the tray passes over the conventional trash bin, it automatically tilts to an angle and this allows the contents of the tray to be released into the trash bin. The tray is then carried through the housing of the apparatus until the platform hits a sensor and the clamp is released. The tray is then placed on the conveyor belt and falls into a specially designed tray storage container. The platform retracts and returns to the front of the housing of the apparatus after the tray has been released to the tray dispenser.

The apparatus for Modified Garbage Collector for Commercial Establishments, described in the present invention has the ability to enable the collection and disposal of garbage in a hygienic manner, is convenient and easy to use, is practical and durable, provides cleanliness, and has the ability to prevent the spread of germs. If manufactured, the apparatus can be offered in various colors and sizes.

DETAILED DESCRIPTION OF THE FIGURES

FIG. 1 illustrates the isometric view of the embodiment, which is the Modified Garbage Collector for Commercial Establishments 101. This figure illustrates parts such as the tray platform opening 102, trash receptacle 103, conveyor belt 104, and door to remove trash 105. In one embodiment, if manufactured, the apparatus can have a capacity of 45 gallons, with size of 24"×24"×40" and weighs approximately 85 lbs. The opening for the tray can measure at 14"×10". The apparatus can be produced from materials such as wood, plastic, or fiberglass. In one embodiment, the tray platform opening 102 for a single tray at a time is on one side of the Modified Garbage Collector. The tray valet 101 moves the tray towards the trash receptacle 103 using the conveyor belt 104. The Modified Garbage Collector is housed inside a unit whose door can be opened to remove the trash accumulated in the trash receptacle 103.

Figure 2:
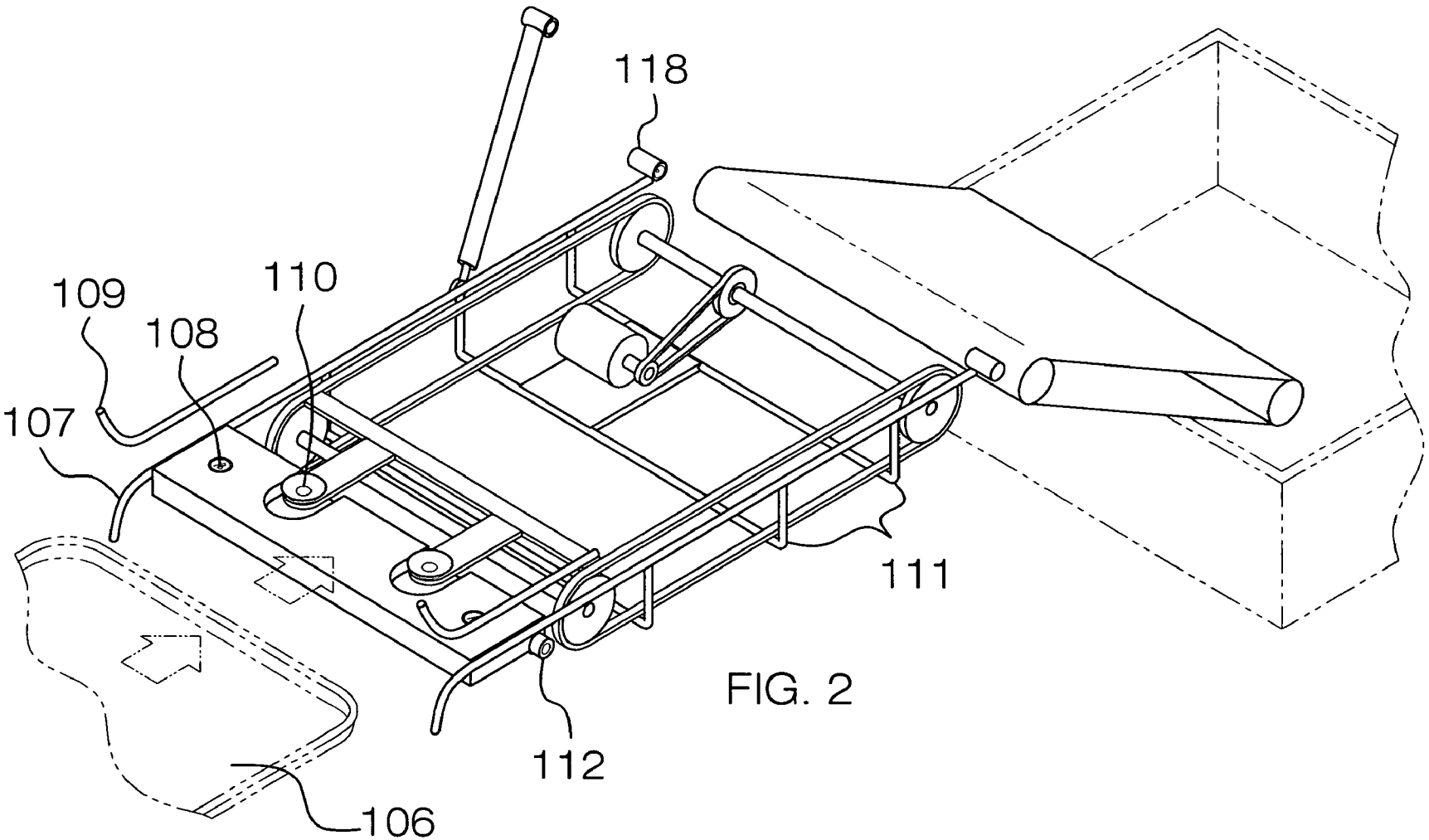

FIG. 2 illustrates the top cross-sectional view of the embodiment shown in FIG. 1. This figure illustrates parts such as the tray 106, lower guide 107, upper guide 109, sensors 108 and 128, suction clamp 110, cross members 111, and pivot point 112. In one embodiment, the tray 106 is placed in the slightly protruding tray platform 102. The tray 106 fits in between the lower 107 and the upper 109 guides. The sensor 108 detects a tray 106 when it is placed on the platform 102. This sensor 108 activates the suction clamp 110, which attaches itself to the bottom of the tray 106 to hold it sturdy. Once the tray 106 is clamped firmly to the platform 102, it moves with the help of the conveyor belt 104 on the gliding track towards the trash receptacle 103. Another sensor 128 detects the arrival of the tray near the edge of the gliding track and it automatically tilts the tray 106 to an angle and allows the contents of the tray 106 to be released into the trash receptacle 103. The pivot point 112, and the cross members 111 are parts of the tray platform 102.

Figure 3:
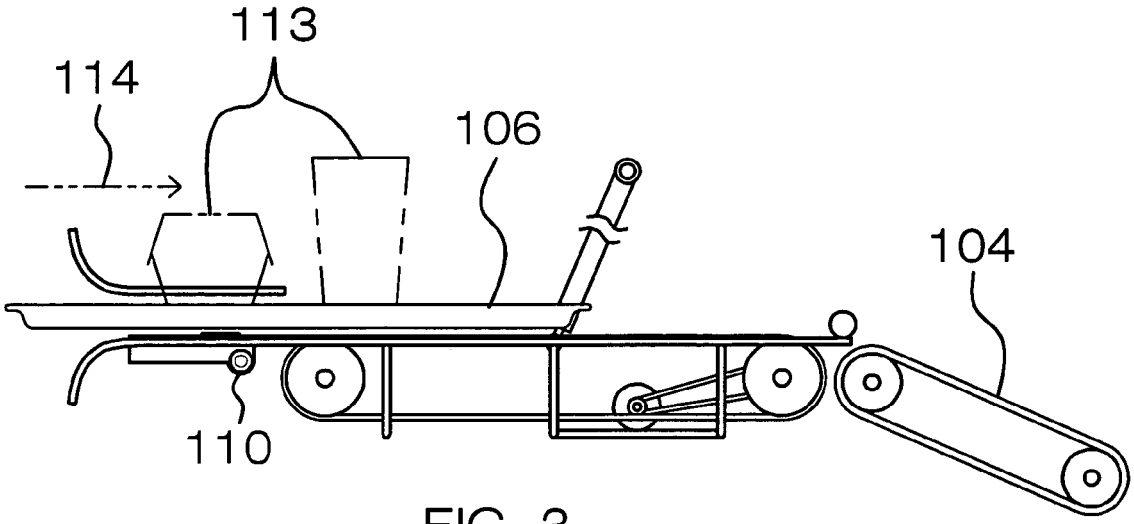

FIG. 3 illustrates the cross-sectional side view of the embodiment shown in FIG. 1 and illustrates the tray 106 with the trash 113 being pushed in 114, conveyer belt 104, and activate suction clamp 110. In one embodiment, the tray 106 is placed in the slightly protruding tray platform 102. The tray 106 fits in between the lower 107 and the upper 109 guides. The sensor 108 activates the suction clamp 110 and moves the tray 106 along with the trash 113 on the gliding track. The gliding track moves with the help of conveyor belt 104.

Figure 4:
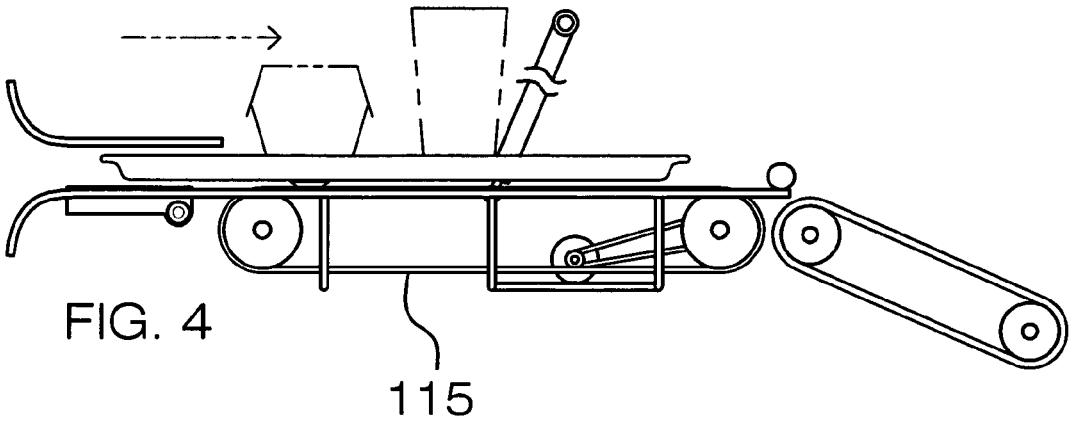
FIG. 4 illustrates the cross-sectional side view of the embodiment shown in FIG. 1 and illustrates the garbage being moved forward when the belt 115 is activated.

FIG. 4 illustrates the cross-sectional side view of the embodiment shown in FIG. 1 and illustrates the garbage being moved forward when the belt 115 is activated. In one embodiment, the tray 106 along with the garbage 114 is moved forward after the suction clamps 110 have clamped down the tray. The gliding track with the tray 106 moves after the belt 115 has been activated.

Figure 5:
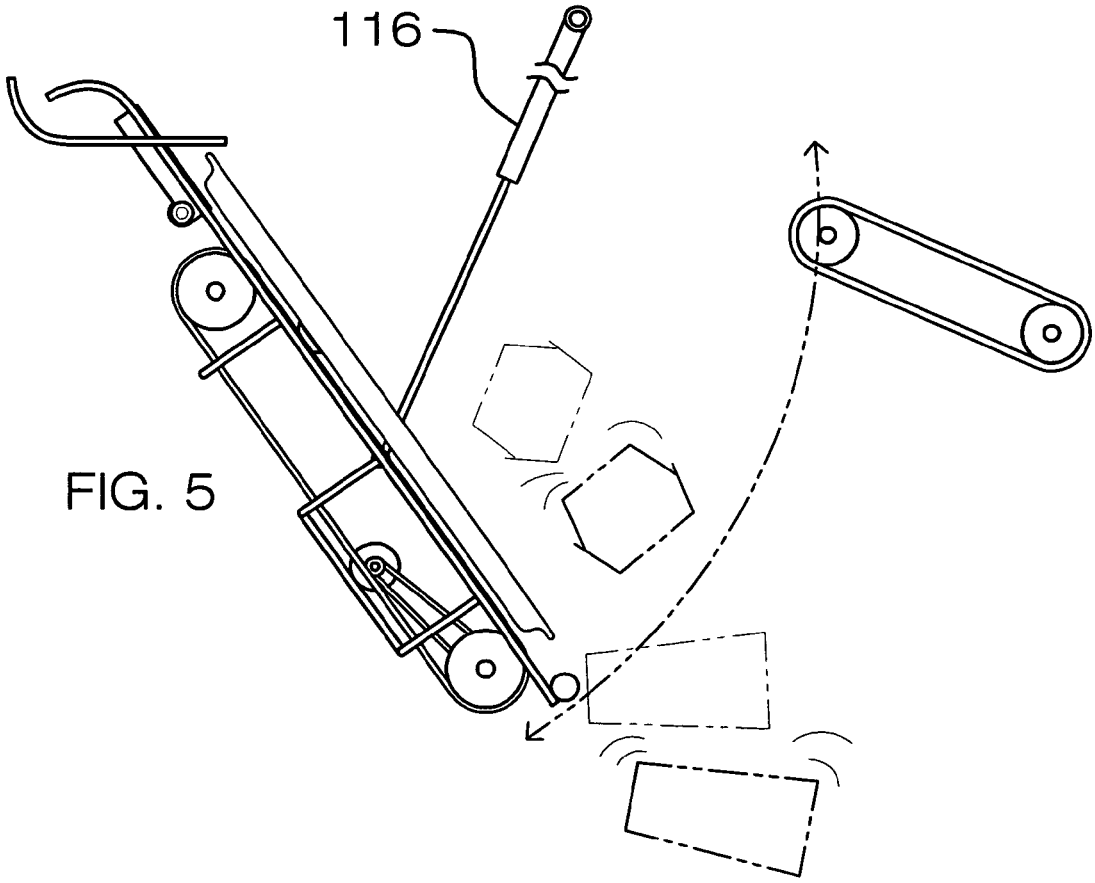
FIG. 5 illustrates the cross-sectional side view of the embodiment shown in FIG. 1 and illustrates the garbage being disposed automatically from the trashcans when the pneumatic cylinder 116 is activated.

FIG. 5 illustrates the cross-sectional side view of the embodiment shown in FIG. 1 and illustrates the garbage being disposed automatically from the trashcans when the pneumatic cylinder 116 is activated. In one embodiment, another sensor 108 detects the arrival of the tray near the edge of the gliding track and it activates the pneumatic cylinder 116 that tilts the tray 106 to an angle and allows the contents 114 of the tray 106 to be released into the trash receptacle 103. After the contents 114 of the tray 106 has been released into the trash receptacle 103, the pneumatic cylinder 116 goes back to its original position taking the tray 106 back to its original horizontal position.

FIG. 6 illustrates the side cross-sectional view of the embodiment shown in FIG. 1 of how the tray 106 moves when the sensor 118 activates the conveyor belt 117 and is stored in the tray dispenser 119 after the garbage has been disposed. After the contents 114 of the tray 106 has been released into the trash receptacle 103, the pneumatic cylinder 116 goes back to its original position taking the tray 106 back to its original horizontal position. The sensor 118 detects that the upright tray 106 and activates the conveyor belt 117, which moves the tray forward to release it to the tray dispenser 119. When the tray 106 reaches the tray dispenser 119, the suction clamps 110 releases the tray 106 and it falls into the tray dispenser 119. The platform 102 retracts and returns to the front of the housing of the apparatus after the tray 106 has been released to the tray dispenser 119. In one embodiment, the tray dispenser is located outside of the trash receptacle. Alternatively, in another embodiment, the tray dispenser is located inside of the trash receptacle While certain exemplary embodiments have been shown and described in the accompanying drawings, it is to be understood that such embodiments are merely illustrative of and not restrictive on the broad invention, and that this invention not be limited to the specific constructions and arrangements shown and described, since various other modification may occur to those ordinarily skilled in the art upon studying this disclosure.

The invention claimed is:

1. An apparatus for food and tray disposal to be used within a trash receptacle comprising:

A platform to slightly extend from an opening of the trash receptacle;

a upper guide and a lower guide for the platform to facilitate the movement of a tray;

a first and a second suction clamps on the platform;

a first sensor on the platform to activate the first and second suction clamps upon detecting the presence of a tray, the first and second clamps to secure the tray to the platform;

a conveyor belt, coupled to the platform to facilitate the movement of the tray to glide across the lower and upper guide;

a cylinder to be released upon detecting the weight of the tray to cause the contents of the tray to be disposed in a trash receptacle, the cylinder then retracts and the tray is placed on the conveyor belt;

the tray storage receptacle;

a second sensor on the platform, located farther down the platform from the first sensor, to release the first and second suction clamps upon detection of the tray, causing the tray to be disposed in a tray storage receptacle.

* * * * *